United States Patent [19]

Ali et al.

[11] Patent Number: 4,467,179

[45] Date of Patent: Aug. 21, 1984

[54] PORTABLE ELECTRIC BASEBOARD HEATER HAVING AN INTEGRAL HANDLE

[75] Inventors: Rafath Ali, Chesterfield; Thomas D. Vaughn, Ballwin, both of Mo.

[73] Assignee: Intertherm Inc., St. Louis, Mo.

[21] Appl. No.: 415,313

[22] Filed: Sep. 7, 1982

Related U.S. Application Data

[63] Continuation-in-part of Ser. No. 378,508, May 17, 1982.

[51] Int. Cl.[3] ..... F24H 9/02; H05B 3/02

[52] U.S. Cl. ..... 219/368; 16/116 R; 165/55; 165/136

[58] Field of Search ..... 219/365–368, 219/341, 533; 16/119, 116 R; 165/55, 136, 128, 129; 237/79

[56] References Cited

U.S. PATENT DOCUMENTS

| | | | |
|---|---|---|---|
| 2,432,917 | 12/1947 | Maurer | 219/341 |
| 3,071,677 | 1/1963 | Mast | 219/365 X |
| 3,267,255 | 8/1966 | Schulz | 219/367 X |
| 3,448,243 | 6/1969 | Ripple | 219/365 X |
| 3,550,680 | 12/1970 | Shriver | 219/365 X |
| 3,799,248 | 3/1974 | Wenig | 165/55 |
| 3,993,978 | 7/1961 | Markel et al. | 219/365 X |
| 4,149,065 | 4/1979 | Goff et al. | 219/367 X |
| 4,262,508 | 4/1981 | Davidson | 16/116 R |
| 4,366,596 | 1/1983 | Hellinger et al. | 16/119 |

FOREIGN PATENT DOCUMENTS

| | | | |
|---|---|---|---|
| 1410529 | 10/1975 | United Kingdom | 219/367 |

*Primary Examiner*—A. Bartis

*Attorney, Agent, or Firm*—Jerome A. Gross

[57] ABSTRACT

A portable electric baseboard heater includes a unitary structural back plate having a central vertical portion bounded by an integral lower triangular closed box-like structure having a downwardly sloping forward surface and an integral upper triangular portion having an upwardly sloping forward surface, a horizontal top surface and a rear vertical wall in the same plane as the central portion and terminating spacedly thereabove to provide a horizontal opening aft of the upwardly sloping forward surface. An angularly bent or molded plastic liner covers the interior of a portion of the top and upwardly sloping surfaces of the upper triangular portion to form an internal thermally insulative handle accessible through the horizontal opening to permit lifting of the heater. The lower triangular portion serves as a protective raceway for power supply wires to an electric finned tube heater assembly supported by the back plate between the upper and lower triangular portions. Feet are provided at the ends of the back plate to support the heater spacedly above a plane of support. The shape of the back plate defines a rigid structural beam which resists loads applied to the heater intermediate its ends.

2 Claims, 4 Drawing Figures

PORTABLE ELECTRIC BASEBOARD HEATER HAVING AN INTEGRAL HANDLE

CROSS REFERENCE TO RELATED APPLICATIONS

This application is a continuation-in-part of application Ser. No. 378,508 filed May 17, 1982, entitled "Baseboard Heater with Circulation-Augmenting Front Plate"; and as to common subject matter the priority date of that application is claimed.

TECHNICAL FIELD

This invention relates to electrical baseboard heaters such as are conventionally used at floor-wall junctions of rooms to provide convection heat.

BACKGROUND ART

Electrical baseboard heaters are familiarly used for convection air heating. If designed to be portable, they are conventionally equipped with an exterior handle. They are made in a variety of lengths, depending upon their voltage. Elongated resistance elements may be used, having terminals at their opposite ends; these are conventionally surrounded by tubular reservoirs for containing a heat transfer liquid, with vertical fins on its exterior. Such heaters may be subject to stresses and distortion during shipment and handling; and the portable units are particularly subject to abuse.

DISCLOSURE OF THE INVENTION

The present baseboard heater has exceptional strength and rigidity; and it is safely wired and easily carried; which advantages follow from the unique construction of its back plate. This back plate, which may be roll-formed to a variety of lengths, has integral upper and lower somewhat triangular forward-slanting hollow portions whose forward surfaces serve as convection air flow directors, while the structural rigidity they afford protects the elongated finned tube resistance heater assembly.

The lower triangle-like portion is a very rigid closed hollow box section, which also serves as a protecting raceway for the end-to-end wiring. The upper triangle-like portion is open beneath an inward-turned rear flange, which forms a convenient handle. For maximum safety, a heat resistant plastic carrying insert may be positioned within this horizontal opening to line the forward and upward sloping surface of the back plate, thus to protect the user's hand when lifting the heater.

THE DRAWINGS

BEST MODE FOR CARRYNG OUT THE INVENTION

Figure 1:
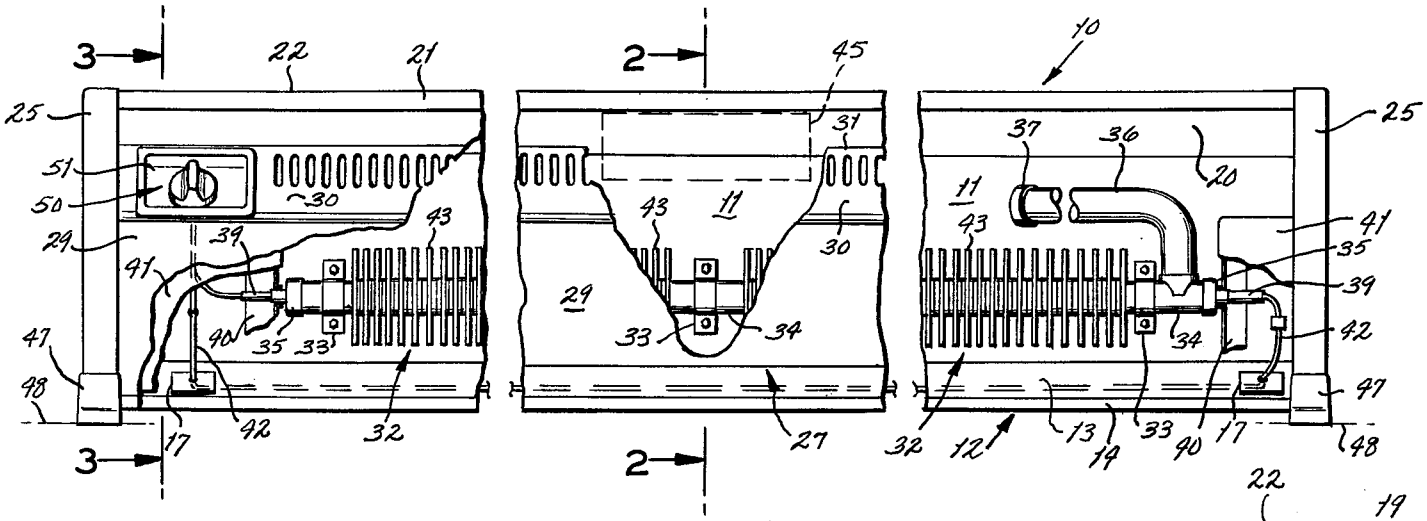
FIG. 1 is a forward elevation, partly broken away, of a baseboard heater incorporating the present invention.
Figure 2:
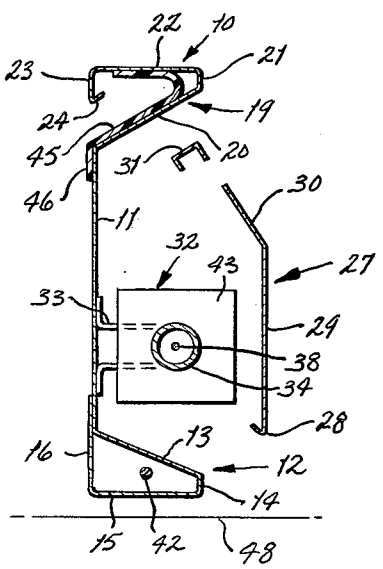
FIG. 2 is a cross-section taken along line 2—2 of FIG. 1.
Figure 4:
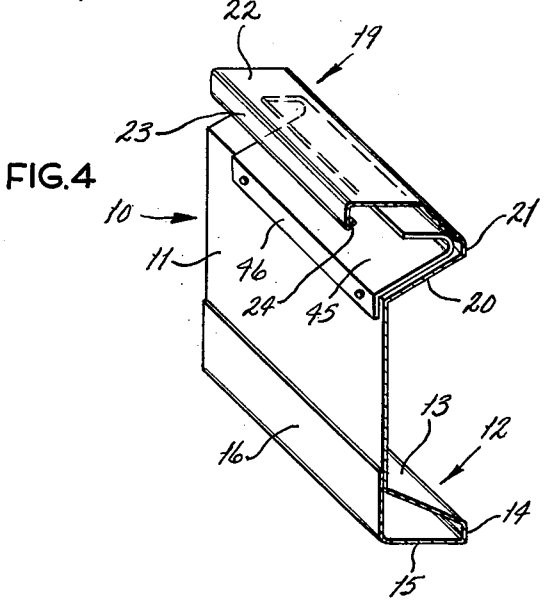
FIG. 4 is a broken-away view of the central portion of the back plate 10, generally corresponding in its location to FIG. 2, showing the installation of a handle insert therein.

A baseboard heater incorporating the present invention is seen assembled in FIG. 1, with its front plate partly broken away. The structure of the heater is comprised principally of a back plate generally designated 10, best seen in FIGS. 2 and 4, which extends the full length of the heater cabinet, to be described. In its preferred form, it is formed integrally by rolling strip steel to the cross-section shown, for any necessary length. It includes a central straight portion 11, from which extends downwardly and forwardly an integral lower, somewhat triangular, closed box-like portion generally designated 12, described as follows: continuing from a juncture with the central straight portion 11 is a downward sloping forward surface 13, which extends to a forward lower edge 14, from which is bent back a horizontal undersurface 15, extending aft to the plane of the central straight portion 11 and thence upward in a rear flange 16 whose margin overlaps the lower part of the central straight portion 11 and is spot-welded to it. This configuration of the lower box-like portion 12 provides strength and deflection resistance to protect the heater against abuse, while its enclosed hollow shape serves as a wiring raceway, as hereafter described.

Blanked through the downward and forward sloping surface 13 near either end of the heater back plate 10 are ports 17, each having a cover plate 18 equipped with a grommet for electrical conductors, to be described.

The back plate 10 further has, extending from the central straight portion 11, an integral upper somewhat triangular portion generally designated 19 including an upwardly and forwardly sloping flow-deflecting surface 20. This forward-sloping surface 20 extends to an upper forward edge 21; from this edge 21 the back plate 10 continues in a top horizontal surface 22 which extends aft, to be bent downward in the plane of the central back plate portion 11, thus forming a top rear flange 23 which terminates spacedly above the central back plate portion 11 in a forward-turned margin 24. The configuration described provides horizontal means conveniently located at the rear upper portion of the back plate 10, by which the heater may be lifted and supported.

In a heater of this type, convection air should flow inward toward the heater, and then upward and outward. The integral portions of the back plate 10, particularly the lower sloping surface portion 13, the central vertical portion 11, and the upper sloping surface 20, thus serve as a flow director for convection air.

Figure 3:
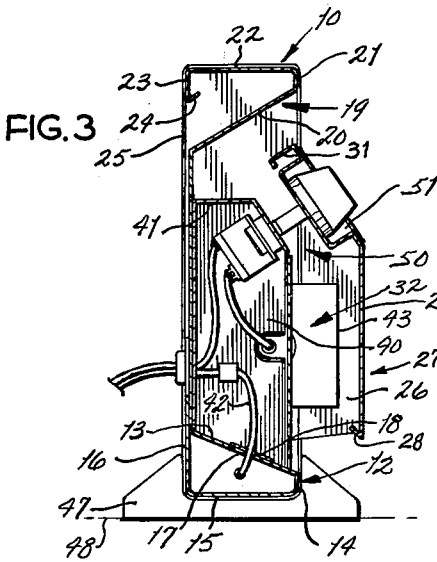
FIG. 3 is a cross-section taken along line 3—3 thereof, also showing the structure at the far end of the heater.

A slender vertical box-like end plate 25, seen in FIGS. 1 and 3, closes each end of the back plate assembly 10. Projecting forward from the end plates 25 are end support brackets 26 for a cabinet front plate generally designated 27 and best seen in FIGS. 1 and 2. Starting at a flanged lower edge 28 it rises vertically to provide a vertical lower front plate portion 29; thereabove it is bent away from vertical at an angle of approximately 35° to provide a sloping slotted portion 30 which terminates in a horizontal upper edge or lip 31. The air outflow opening between the lip 31 and the upward and forward sloping forward surface 20 of the back plate assembly 10 may suitably be approximately 20 mm. The back plate 10, end plates 25 and front plate 27 with its support brackets 26 form the efficient convection cabinet of the heater.

A finned tube assembly generally designated 32 is mounted on the back plate 10 positioned behind the front plate 27 and between the lower and upper triangular portions 12, 19. To utilize the maximum protection from structural deflection that the back plate configuration offers, as well as for enhancing convective flow, the finned tube assembly 32 is positioned substantially closer to the lower triangular portion 12 than it is to the upper triangular portion 19 approximately as shown. It is supported by a series of brackets 33 mounted at convenient spacings to the back plate vertical portion 11. These brackets 33 embrace a hollow metal heater reservoir tube 34 which, in the preferred embodiment, contains water and anti-freeze surrounding an electrical resistance element 39. The reservoir tube 34 has brazed end caps 35 and, adjacent to the right end cap 35, an expansion or riser tube 36 closed by a pressure-relieving safety closure 37 as seen in FIG. 1.

Extending lengthwise along the axis of the reservoir tube 34 and projecting through its end caps 35 is a conventional electric resistance heater element 38 having insulated terminal ends 39. These terminal ends 39 pass through horizontally-slotted support ribs 40 mounted on the back plate 10 and are enclosed by and housed in junction or closure boxes 41. Electrical connectors 42, connected to the terminal ends 39, run through the closure boxes 41 and pass through grommets in the cover plates 18 for the ports 17, and thence through the back plate lower triangular portion 12, thus conventionally connecting the heater terminal end 39, to a switch generally designated 50 shown in FIG. 3 (as well as to other conventional control elements, not shown) and then to a power source. The switch 50 is seen mounted in the left junction or closure box 41 and its control projects therefrom through a rectangular cup 51 recessed in the front plate 27. It is significant for safety that the lower triangular portion 12 of the back plate 10 serves as a rigid protective wiring raceway.

Where not interrupted by support brackets 33, the reservoir tube 34 has, mounted on it in conventional heat-conductive relationship, a plurality of slender spaced heat-dissipating fins 43, preferably square in outline. Heat is dissipated by the fins to the convection air which passes upward into the heater cabinet forwardly of the sloping lower surface 13, thence upward between the back plate central portion 11 and the front plate 27, and thence to be deflected outwardly forward of the upper forward surface 20.

If the heater is to be of the portable type, in order to protect the user's hand from heat when lifting the heater, the horizontal opening at the rear, beneath the flange 23 and margin 24, is fitted at its center with a thermally insulative non-metallic handle liner such as the molded or bent plastic liner insert 45 which lines the aft side of the back plate sloping forward surface 20. Being slender this liner insert 45 is readily positioned by deflecting it to fit it through the opening, into which it springs into place; a lower flange 46 formed downwardly on the insert 45 is then riveted to the vertical back plate portion 11.

Also, portable heaters are equipped with molded plastic feet 47 affixed to the box-like end plates 25 to provide support above the floor designated level 48, at a height chosen to promote inflow of the air. When the feet 47 are in place, the back plate 10 serves as a structural beam, which resists deflection accompanying loads exerted on its top surface 22 and thus protects the heater tube assembly and other delicate components from damage.

If the heater is to be permanently installed, the plastic molded insert 45 is not necessary; instead it may be suspended by clips, not shown, beneath the top rear flange 23. In this event, the opening beneath this flange serves to aid both in handling and installation.

By the construction described, the unique back plate 10, roll formed to any desired length, achieves, with strength and simplicity, the purposes set forth in the foregoing "Disclosure of the Invention". From this specification, various modifications will suggest themselves to persons familiar with the art and interested in specific utilizations of this invention.

As used in this specification and claims, the terms "generally triangular" and "substantially triangular" are to be taken to comprise sheet metal sections having substantially sloping forward portions and substantially vertical rear walls, as well as upper or lower surface portions.

INDUSTRIAL APPLICABILITY

The principal anticipated use of the present invention is for electric baseboard heaters for rooms in homes, hotels, motels, offices and the like.

We claim:

1. For supplying heated air by convection, a portable baseboard heater comprising a unitary back plate, extending the length of the heater having a central straight vertical portion, bounded by a lower integral hollow generally triangular closed box-like portion having a forward surface sloping downward and forward from a junction with said central portion, and having a pair of ports through said sloping surface, one positioned adjacent to each end of the baseboard heater, and by an upper integral generally triangular portion having a forward surface sloping upward and forward from a junction with said central portion to a horizontal top surface extending aft to an integral vertical flange formed downwardly in substantially the same plane as said straight central portion and terminating spacedly thereabove in a forward turned margin, whereby to provide a horizontal opening aft of said forward and upward sloping surface of the back plate, together with thermally insulative non-metallic internal handle means in the space between the said top surface and the said upper forwardly sloping surface and accessible through said horizontal aft opening, whereby to permit lifting the heater while in operation, and means at both ends of said back plate to support it spacedly above a floor plane of support, whereby said back plate serves as a structural beam to resist loads applied to said heater intermediate its ends, in combination with a forward plate-like member supported spacedly forward of the central portion of the back plate, a straight elongated electrical resistance finned tube assembly supported by said back plate behind the forward plate in a position between said upper and lower triangular portions, said finned tube assembly being of the type having opposite electric terminal ends, and electrical connector means connecting said terminal ends and extending through said ports and lower box-like portion, whereby said closed box-like portion serves as a protective wiring raceway and affords strength and deflection-resistance to the baseboard heater.

2. A portable baseboard heater as defined in claim 1, wherein the thermally insulative non-metallic handle means includes an angularly bent plastic liner within said upper triangular portion and covering substantially the interior of said top surface and the interior of said sloping surface thereof, said handle means being accessible through said horizontal aft opening.

* * * * *